US011331540B2

(12) United States Patent
Bingham

(10) Patent No.: US 11,331,540 B2
(45) Date of Patent: May 17, 2022

(54) ROPE CLIMBING MECHANISM WITH CONTROLLED DESCENT CLUTCH BODY INCLUDING PIVOTALLY ASSOCIATED DESCENT LEVER

(71) Applicant: S. Kevin Bingham, Detroit, MI (US)

(72) Inventor: S. Kevin Bingham, Detroit, MI (US)

( * ) Notice: Subject to any disclaimer, the term of this patent is extended or adjusted under 35 U.S.C. 154(b) by 37 days.

(21) Appl. No.: 17/035,941

(22) Filed: Sep. 29, 2020

(65) Prior Publication Data

US 2021/0093923 A1 Apr. 1, 2021

Related U.S. Application Data

(60) Provisional application No. 62/908,637, filed on Oct. 1, 2019.

(51) Int. Cl.
*A63B 29/02* (2006.01)
*A62B 1/14* (2006.01)

(52) U.S. Cl.
CPC ..... *A63B 29/02* (2013.01); *A62B 1/14* (2013.01)

(58) Field of Classification Search
CPC ..... A63B 29/02; A62B 1/14
See application file for complete search history.

(56) References Cited

U.S. PATENT DOCUMENTS 5,975,243 A 11/1999 Lorbek
6,029,777 A 2/2000 Rogelja
6,732,833 B2 * 5/2004 Rogelja ..... A63B 29/02 182/5
6,899,203 B1 * 5/2005 Golden ..... A62B 1/14 182/5
8,701,840 B2 4/2014 Allen
8,733,739 B2 * 5/2014 Mauthner ..... A63B 29/02 254/391
9,192,792 B2 11/2015 Moine et al.
9,498,655 B2 11/2016 Paglioli
9,498,660 B2 11/2016 Moine et al.
10,036,202 B2 7/2018 Bornack
10,092,781 B2 10/2018 Malcolm
10,173,081 B2 * 1/2019 Rogelja ..... A62B 1/14
10,258,829 B2 4/2019 Merritt
10,471,306 B2 11/2019 Ngah
10,583,315 B2 3/2020 Malcolm
(Continued)

FOREIGN PATENT DOCUMENTS

AU 2016244823 B2 5/2020
GB 1007645 A 10/1965
WO 2016003369 A1 1/2016

*Primary Examiner* — David M Upchurch
(74) *Attorney, Agent, or Firm* — Dinsmore & Shohl LLP

(57) ABSTRACT

A clutch assembly for a climbing rope including a tether component pivotally supporting a plate, the plate in turn supporting a pair of pivotal clutch members defining a first pinch point of the rope. A carabiner pivotally attachable to the tether component through an aligning support aperture in the plate. A lever is pivotally attached to the tether component and slidably attached to the plate which permits at least one of sliding displacement or pivoting of the plate relative to the tether component to establish each of a sliding configuration of the rope relative to the clutch members during either of a normal ascent or normal descent condition, as well as a locked configuration of the clutch members against the rope to establish a free-fall preventing condition.

19 Claims, 10 Drawing Sheets

(56) References Cited

U.S. PATENT DOCUMENTS

| | | | | |
|---|---|---|---|---|
| 2002/0112916 | A1* | 8/2002 | Ador | A62B 1/14 182/5 |
| 2002/0112917 | A1* | 8/2002 | Ador | A62B 1/14 182/5 |
| 2007/0215411 | A1* | 9/2007 | Petzl | A62B 1/14 182/193 |
| 2009/0120738 | A1* | 5/2009 | Everett | A62B 1/14 188/65.4 |
| 2011/0258815 | A1* | 10/2011 | Everette | A62B 1/14 24/134 R |
| 2012/0103725 | A1 | 5/2012 | Johansson et al. | |
| 2012/0193166 | A1 | 8/2012 | Rogelja | |
| 2013/0180800 | A1* | 7/2013 | Mauthner | A62B 1/14 182/5 |
| 2014/0020983 | A1* | 1/2014 | Casebolt | A62B 35/0037 182/241 |
| 2014/0174850 | A1 | 6/2014 | Paglioli et al. | |
| 2015/0034894 | A1 | 2/2015 | Ball et al. | |
| 2015/0114752 | A1 | 4/2015 | Bornack | |
| 2017/0106216 | A1* | 4/2017 | Ollivier | F16D 63/008 |
| 2017/0189725 | A1 | 7/2017 | Malcolm | |
| 2019/0351264 | A1* | 11/2019 | Ratalino | A62B 1/14 |
| 2021/0330995 | A1* | 10/2021 | Chu | A62B 1/14 |

* cited by examiner

ROPE CLIMBING MECHANISM WITH CONTROLLED DESCENT CLUTCH BODY INCLUDING PIVOTALLY ASSOCIATED DESCENT LEVER

CROSS REFERENCE TO RELATED APPLICATIONS

The present application claims the priority of U.S. Ser. No. 62/908,637 filed Oct. 1, 2019.

FIELD OF THE INVENTION

The present invention teaches a clutch style climbing assist device for facilitating up and down motion of a climber using a rope slidably guided within the device. Linkages incorporated into the assist device permit substantially friction free translation of the rope during normal ascent (also termed progress capture) and descent (including fall arrest or variable friction) motions. A climber secured carabiner pivotally secures to an elongated tether linkage and overlapping lower side plates of the device and, in response to occurrence of a free fall condition (hands free relative to the climbing rope) a clutch assembly of the device prevents further translation of the rope until an associated lever is re-engaged downwardly to re-establish controlled descent.

BACKGROUND OF THE INVENTION

The prior art is documented with examples of clutch mechanisms such as which are employed by climbers during ascending and descending (rappelling) motion. The objective is to provide the climber with an effective means to guide a climbing rope through the mechanism during an ascending motion, combined with the ability of the mechanism to engage the rope to prevent an otherwise free-fall descent condition, such as occurring in instances in which the climber loses grip on the rope during descending/rappelling.

Traditional pulley and sheave arrangements are also known in the prior art. A pulley by definition is a wheel on an axle or shaft that is designed to support movement and change of direction of a taut cable or belt, or to transfer power between a shaft and a cable or belt. In the case of a pulley supported by a frame or shell which does not transfer power to a shaft, but is used to guide the cable or exert a force, the supporting shell is called a block, and the pulley in this instance is referred to as a sheave.

A pulley may also have a groove or grooves located between flanges around its circumference to locate the cable or belt. The drive element of a pulley system can include any of a rope, cable, belt or chain. In this manner, pulleys can be assembled to form a block and tackle in order to provide a mechanical advantage to apply load forces. Pulleys can also be assembled as part of a belt and chain drive in order to transmit power from one rotating shaft to another.

A sheave by definition is a pulley with a grooved wheel for holding a belt, wire rope or rope. The grooved wheel spins on the axle or bearing inside the frame of the block. This allows the wire or rope to move freely to minimize friction and wear on the cable. In this manner, sheaves can be used to redirect a cable or rope, lift loads, and transmit power. Accordingly, the terms sheave and pulley can and are sometimes used interchangeably.

SUMMARY OF THE PRESENT INVENTION

The present invention discloses a clutch assembly for a climbing rope including a tether component pivotally supporting a plate, the plate in turn supporting a pair of pivotal clutch members defining a first pinch point of the rope. A carabiner pivotally attachable to the tether component through an aligning support aperture in the plate. A lever is pivotally attached to the tether component and slidably attached to the plate which permits at least one of sliding displacement or pivoting of the plate relative to the tether component to establish each of a sliding configuration of the rope relative to the clutch members during either of a normal ascent or normal descent condition, as well as a locked configuration of the clutch members against the rope to establish a free-fall preventing condition.

The plate can further include a pair of plates arranged on opposite sides of the tether component for supporting the clutch members therebetween in a pulley or sheave style arrangement in which the clutch members can each further include a triangular shaped and exhibit opposed hypotenuse surfaces between which translates the rope and in order to provide the necessary mechanical advantage for advancing the device up the rope. As is further understood, and without the pulley feature, the device has to be lifted up the rope and cannot be pushed up the rope by the device itself.

In a further embodiment, the lever component is reconfigured/shortened to remove its end-most gripping portion and a separate elongated member is anchored directly to the plate so that the associated mounting bolt extends through an end-most location of the interior slot configured in the lever component. A roller element is supported at a remote end of the elongated member. A first arcuate member is pivotally secured to the elongated member and includes a recessed profile opposing the roller element. A second bean-shaped component is separately pivotally mounted to the plate and, in combination with the first arcuate member, can be compressed in a clam-shell manner to compress the rope between the bean-shaped component and the roller in order to provide a variable friction and controlled descent, and such as resulting from any downward directed pivoting of the climber attached carabiner relative to the elongated tether linkage and overlapping lower side plates of the device.

A first torsional spring is provided for influencing at least one of the clutch members in the locked configuration. A second pinch point of the rope is established by a pair of "L" plates pivotally supported at an upper end of the tether component. A second torsional spring pivots the "L" plates in the locked configuration. The second pinch point further includes a pair of spaced shafts or pins between which translates the rope.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
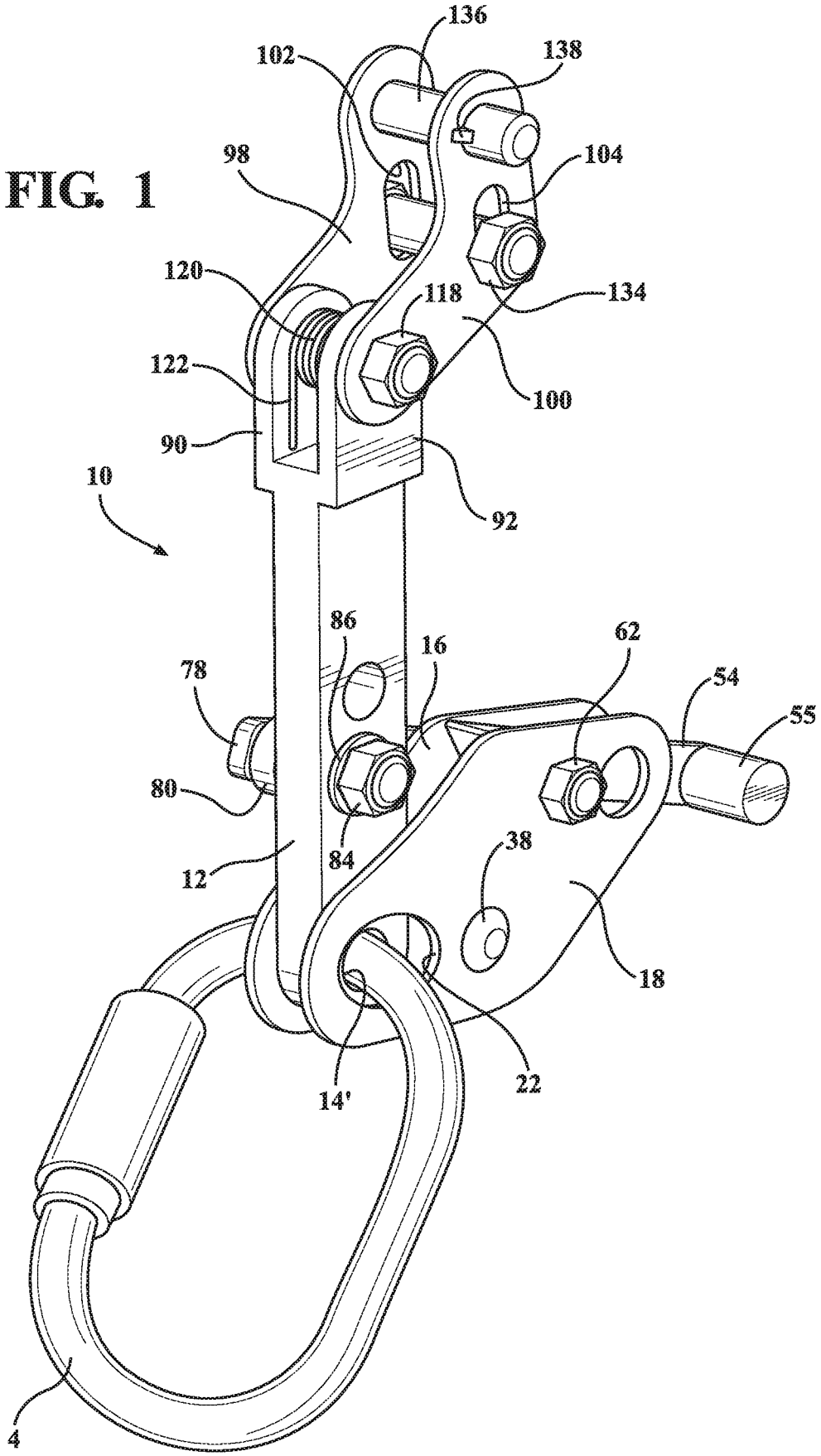
FIG. 1 is a perspective view of an embodiment of the climbing assist mechanism according to the present invention.

With reference to the attached illustrations, the present invention discloses a clutch style climbing assist device, shown generally at 10 in FIG. 1, for facilitating up and down motion of a climber (not shown) using a rope 2 (see each of FIGS. 3-5) which is slidably guided within the device. As will be further described, linkages incorporated into the assist device permit substantially friction free translation of the rope 2 during normal ascent (progress capture) and descent (variable friction inducing) motions.

A climber secured carabiner (see at 4 attached to climber at location 6 in each of FIGS. 3-5) in turn pivotally secures to an elongated tether component 12 via a lower end proximate aperture 14. Side plates 16 and 18 each include an overall shaped aperture (see rim edges 20/22) which are arranged in a sandwiched configuration overlapping the lower end aperture 14 of the tether component 12 so that the carabiner 4 is secured through the enlarged oval apertures 20/22 of the side plates 16/18 along with the tether component 12.

Figure 2:
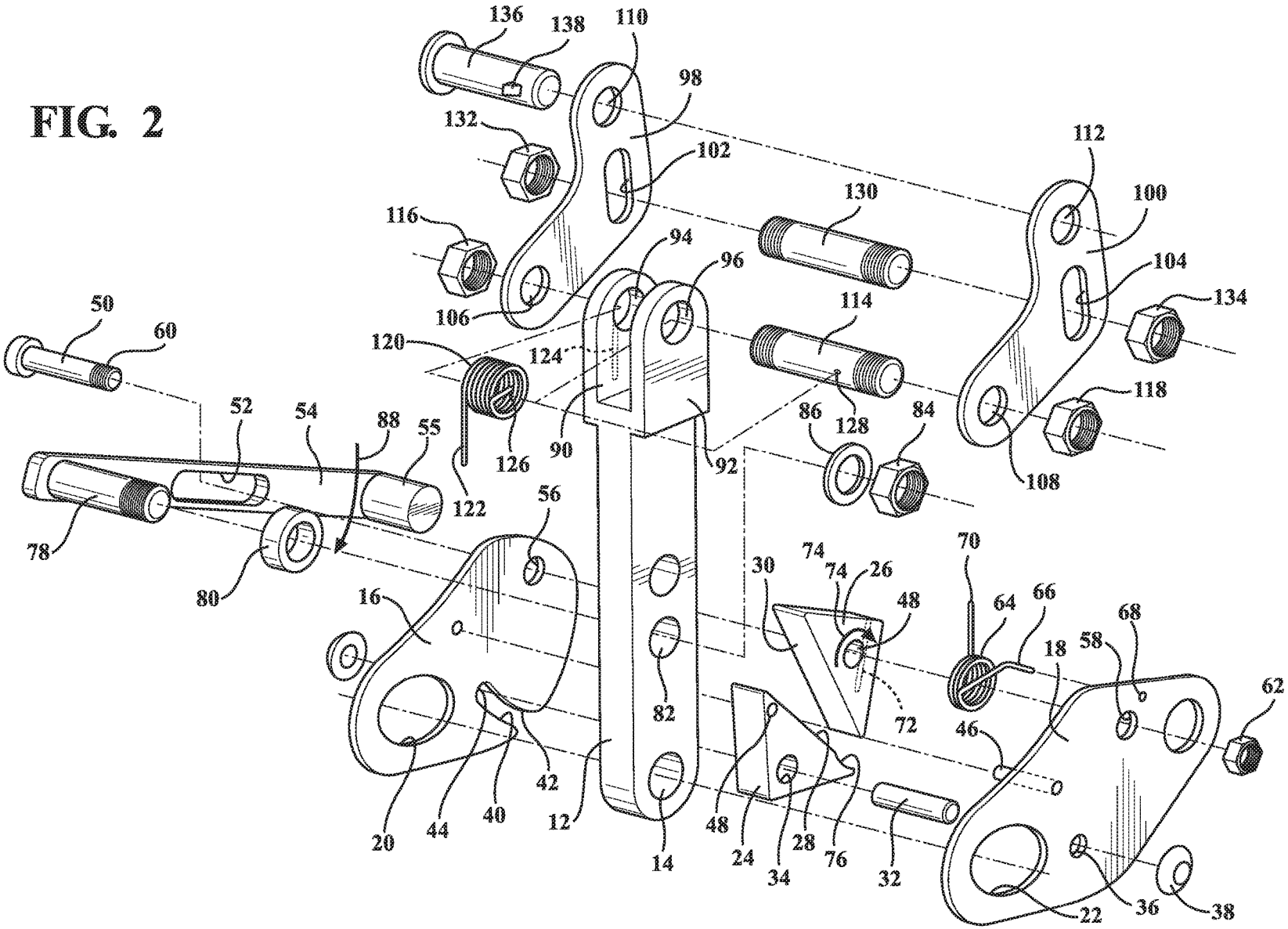
FIG. 2 is an exploded view of the climbing assist mechanism according to the present invention.

With reference again to the exploded view of FIG. 2, a pair of triangular shaped clutch members are shown at 24 and 26 and are pivotally secured in a package defining fashion between the side plates 16 and 18 so that hypotenuse extending sides 28 and 30 are generally arranged opposing one another. Clutch member 24 is secured via a pin 32 which extends through an aperture 34 in the clutch member 24, the pin 32 seating within an aperture 36 in side plate 18 and held in place by attachment cap 38. The combination of the side plates 16 and 18, along with the clutch members 24 and 26, provides the desired pulley or sheave effect (as described above) and in order to provide the necessary mechanical advantage in order to advance the device up the rope 2.

An outer edge communicating and interior extending arcuate channel is depicted by profile surfaces 40 and 42 and terminates at a rounded inner edge 44. Upon assembly, the pin 32 seats within the interior extending channel 40/42 to permit a minor range of pivotal motion of the triangular clutch member 24, as further dictated by a further pivot mount location guided by pin 46 which seats within a corner located aperture 48 of the clutch member 24.

Clutch member 26 includes an aperture (see inner perimeter rim 48) for receiving a mounting bolt 50 extending through an interior slot 52 configured within a lever component 54 having an end-most gripping portion 55. The bolt 50 extends through a further aperture 56 before extending through the aperture 48 in the clutch member 26 and a further aligning aperture 58, with a threaded shaft end 60 being engaged by an interiorly threaded nut 62.

A torsional spring 64 is located between the clutch member 26 and the side plate 18. A first extending leg 66 of the spring 64 seats through aperture 68 in side plate 18. Opposite extending leg 70 seats in a shallow trench slot 72 depicted in opposing surface of clutch member 26 and so that the clutch member is biased in a counter clockwise direction as depicted by directional arrow 74.

As will be described with reference to subsequent illustrations FIGS. 3-5, the rope 2 translated between the clutch members 24/26 so that lower corner edges thereof pinch the rope therebetween in a clutch engaging position of FIG. 3. The selected clutch member 24 can optionally include a contoured or guided edge profile shown at 76 which can enhance gripping of the rope 2 in the engaged condition.

The lever 54 includes a forward mounted bolt fastener portion 78 which receives a collar spacer 80 prior to the shaft of the fastener passing through an aperture 82 at a midpoint location of the tether 12 a distance above the lower aperture 14. Threaded shaft end of the lever bolt fastener portion 78 is then engaged by nut 84 and optionally washer 86. In this manner and upon assembly with the clutch device, the lever can be pivotally rotated in the manner of directional arrow 88 (see also FIG. 5) concurrent with the lever sliding via the seating arrangement of the bolt 50 through the interior channel 52 so that the clutch members 24/26 are both likewise influenced in a pivoted and similar clockwise direction (as compared to their position shown in FIG. 3) during normal descent/rappelling motion.

The tether component 12 further includes an upper pedestal end exhibited by a pair of upward extending and spaced apart flange portions 90 and 92. A pair of aligning apertures 94/96 are formed through the flange portions 90/92. A pair of upper "L" shaped plates 98 and 100 are provided and each includes an elongated middle slot portion 102/104, a lower end aperture 106/108 and an upper end aperture 110/112.

A first dual threaded end coupler shaft 114 with end attachment nuts 116/118 is provided for pivotally attaching the "L" plates 98/100 through their lower end aligning apertures 106/108. A second torsional spring 120 secures within the space between the flange portions 90/92 in alignment with the apertures 94/96 and includes a first downward extending leg 122 which seats within a shallow linear trench 124 configured within the tether component 12 in communication with an inside surface of selected flange portion 90 of the upper pedestal. A second inwardly curled leg 126 engages an aperture 128 in the threaded coupler shaft 114 in order to maintain a slight counter clockwise bias on the "L" plates 98/100 which influences the plates to act as a secondary brake on the rope 2 in the clutch engaged position of FIG. 3.

In operation, the rope 2 is engaged between a second dual threaded end coupler shaft 130 seated within the elongated middle slots 102/104 (see also end attached interiorly threaded engagement nuts 132/134) and a further upper end engaged bolt key 136 which includes a lateral spring loaded detents 138 and 140 which seat through the upper end apertures 110/112. In this manner, the hands free configuration of the clutch brake assembly, as depicted in FIG. 3, responds to occurrence of any of a fall arresting or free fall condition (hands free relative to the climbing rope and as further referenced by directional arrow 142) by the triangular shaped clutch members 24 and 26 pivoting (as influenced by the clockwise exerted bias 74 of the first torsional spring 64), and so that the opposing hypotenuse surfaces 28/30 grip the rope 2 at a first location 2' to prevent further translation of the rope until the associated lever 54 is re-engaged downwardly to re-establish controlled descent. Concurrently, the rope is gripped at a second upper location 2" between the shaft 130 and upper bolt key or pin 136, via the counter clockwise bias exerted by the second torsional spring 120 on the upper "L" plates 98/100.

In this configuration, the lower side plates 16/18 are generally influenced in a generally upward displaced direction via shifting of the plates via the oval/oblong apertures 20/22 which seat the carabiner 4. It is also noted that the essential gripping of the rope occurs at location 2' and that the secondary gripping location 2" by the "L" plates 98/100 is complementary and, in given applications, is not required.

Figure 3:
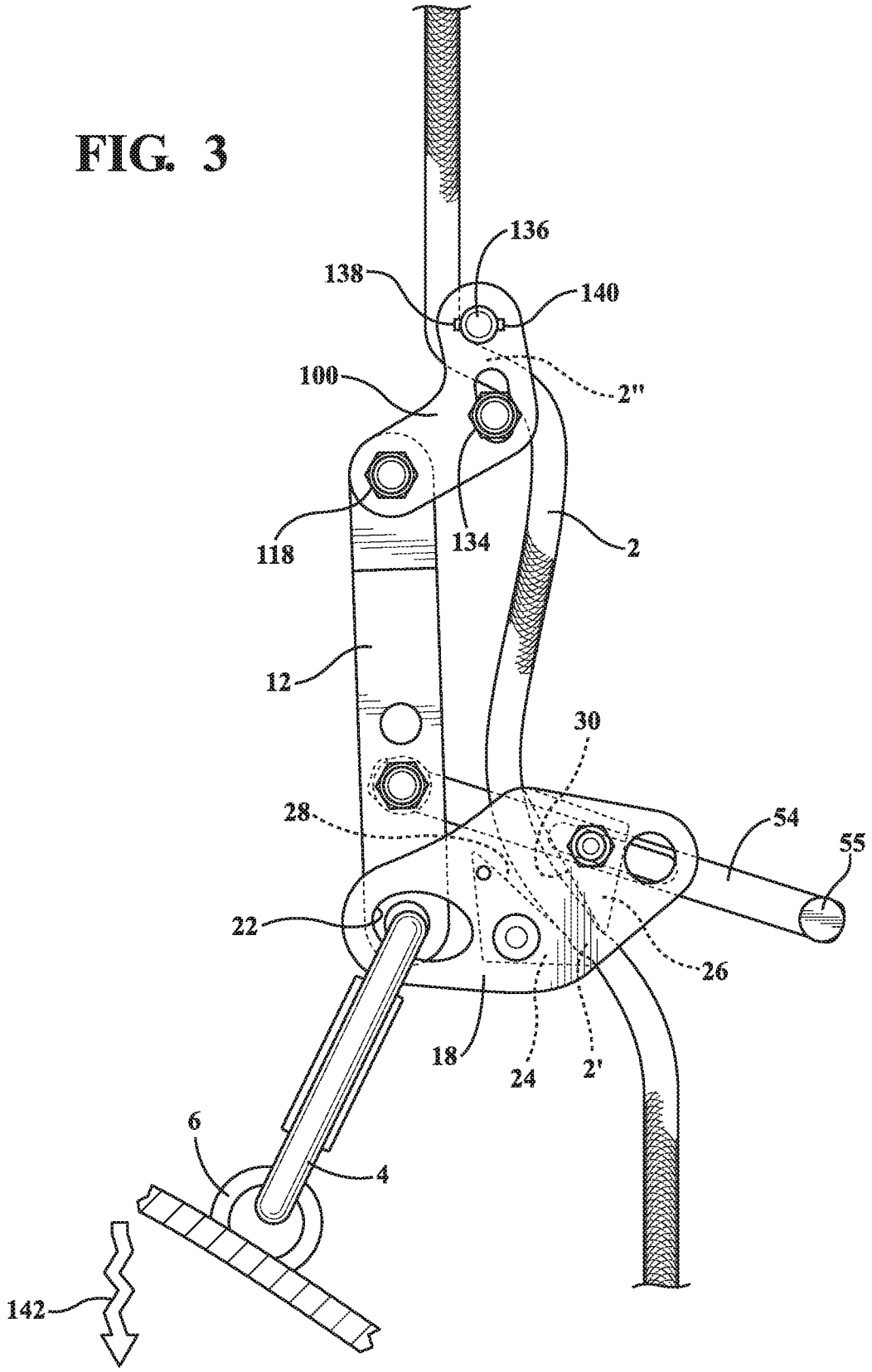
FIG. 3 is an operational depiction of the mechanism in use with the rope and depicting the clutch engaging the rope in response to any of a free fall or fall arrest condition.
Figure 4:
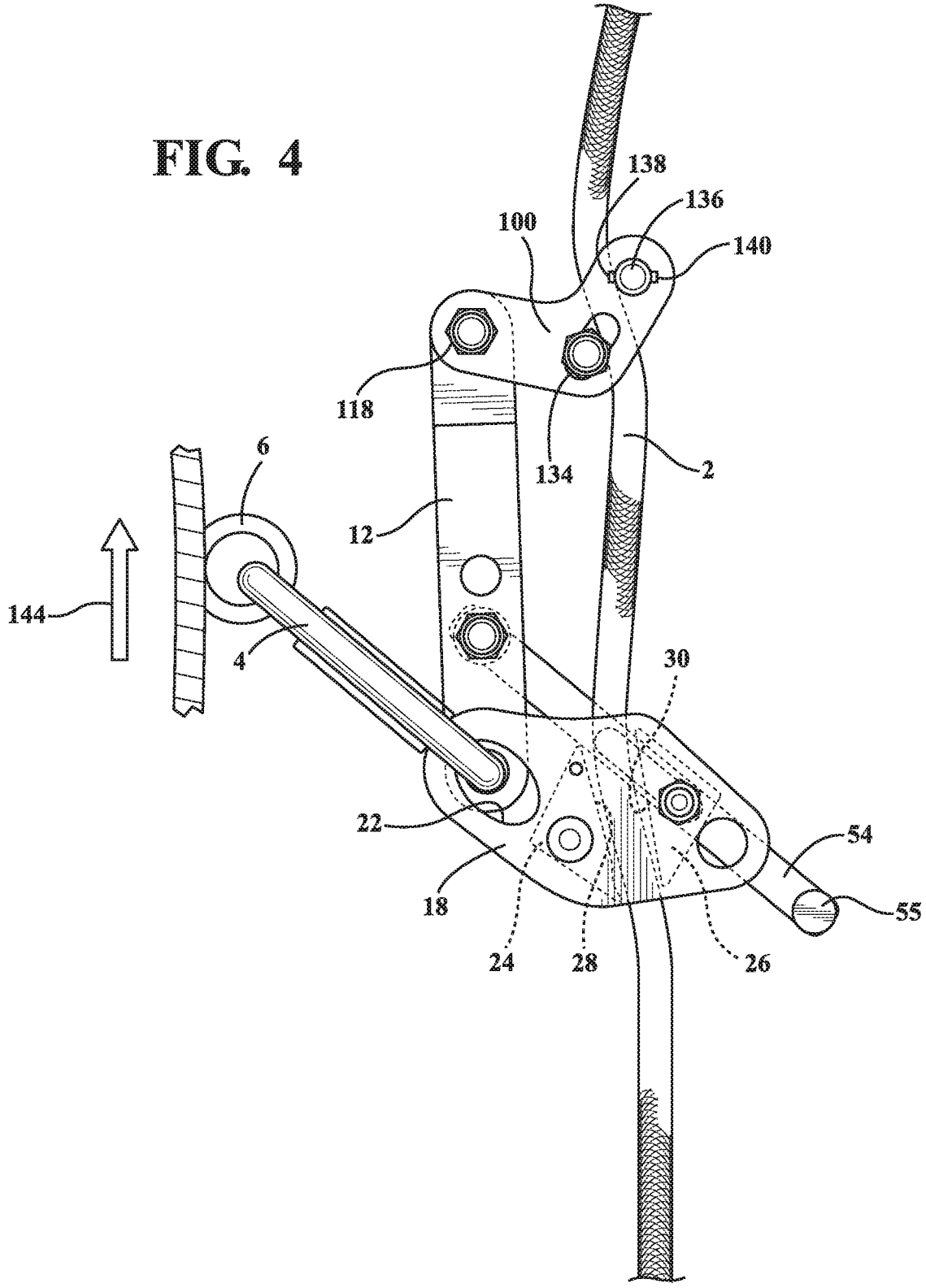
FIG. 4 is a view similar to FIG. 3 depicting the mechanism in a controlled ascent (also termed progress captures) configuration in relation to the rope translating downwardly therethrough.

Proceeding to FIG. 4, a view similar to FIG. 3 is shown depicting the mechanism 10 in a controlled ascent (also progress capture) configuration (see directional arrow 144) in relation to the rope 2 translating downwardly therethrough. In this position, the triangular clutch members 24/26 both pivot in a generally clockwise direction relative to that shown in FIG. 3, and by which the rope 2 is generally permitted to slide downwardly through the pinch points established at each of the upper "L" plates 98/100 (see clockwise rotation of plates 98/100 from position of FIG. 3 concurrent with seating of the mounting shaft 130 toward the bottom of the elongated apertures 102/104), as well as at the lower side plates 16/18 and enclosed clutch members 24/26.

Figure 5:
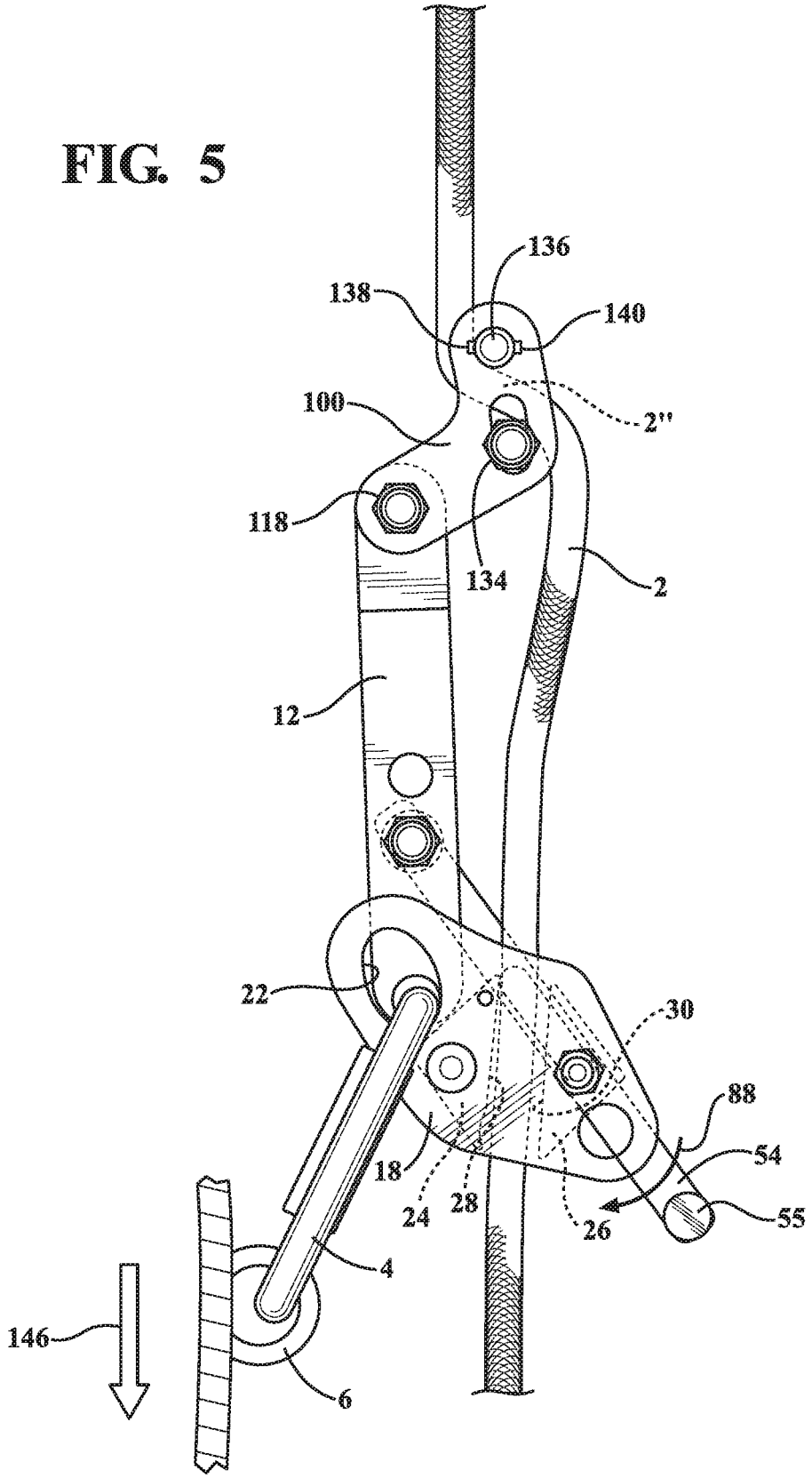
FIG. 5 is a further illustration of the mechanism in a controlled descent (also termed variable friction) configuration resulting from downward directed pivoting of the climber attached carabiner relative to the elongated tether linkage and overlapping lower side plates of the device.

FIG. 5 provides a further illustration of the mechanism in a controlled descent (variable friction) configuration (see downward directional arrow 146) resulting from downward directed pivoting of the climber attached carabiner 4 relative to the elongated tether linkage 12 and overlapping lower side plates 16/18 of the device. In this manner, the clutch members 24/26 are further clockwise pivoted (again via downward pivoting of the lever 54) to allow for sliding of the rope therethrough and in combination with the upper "L" plates reverse (ccw) pivoting to provide a nominal degree of engagement at the upper pinch point 2". The lever 54 further operates as a fulcrum (such as by gripping the end portion 55) to adjust an amount of mechanical advantage applied to the pinching cam of the device in order to achieve the desired variable friction for establishing controlled descent.

With reference to FIGS. 6-10, a slightly modified variant (see at 10' in FIG. 6) is provided of the clutch style climbing assist device. For purposes of ease of description, common elements to FIGS. 1-5 are repetitively enumerated and description will be limited to the redesigned aspects of the manually (hand) operated clutch subassembly.

Figure 6:
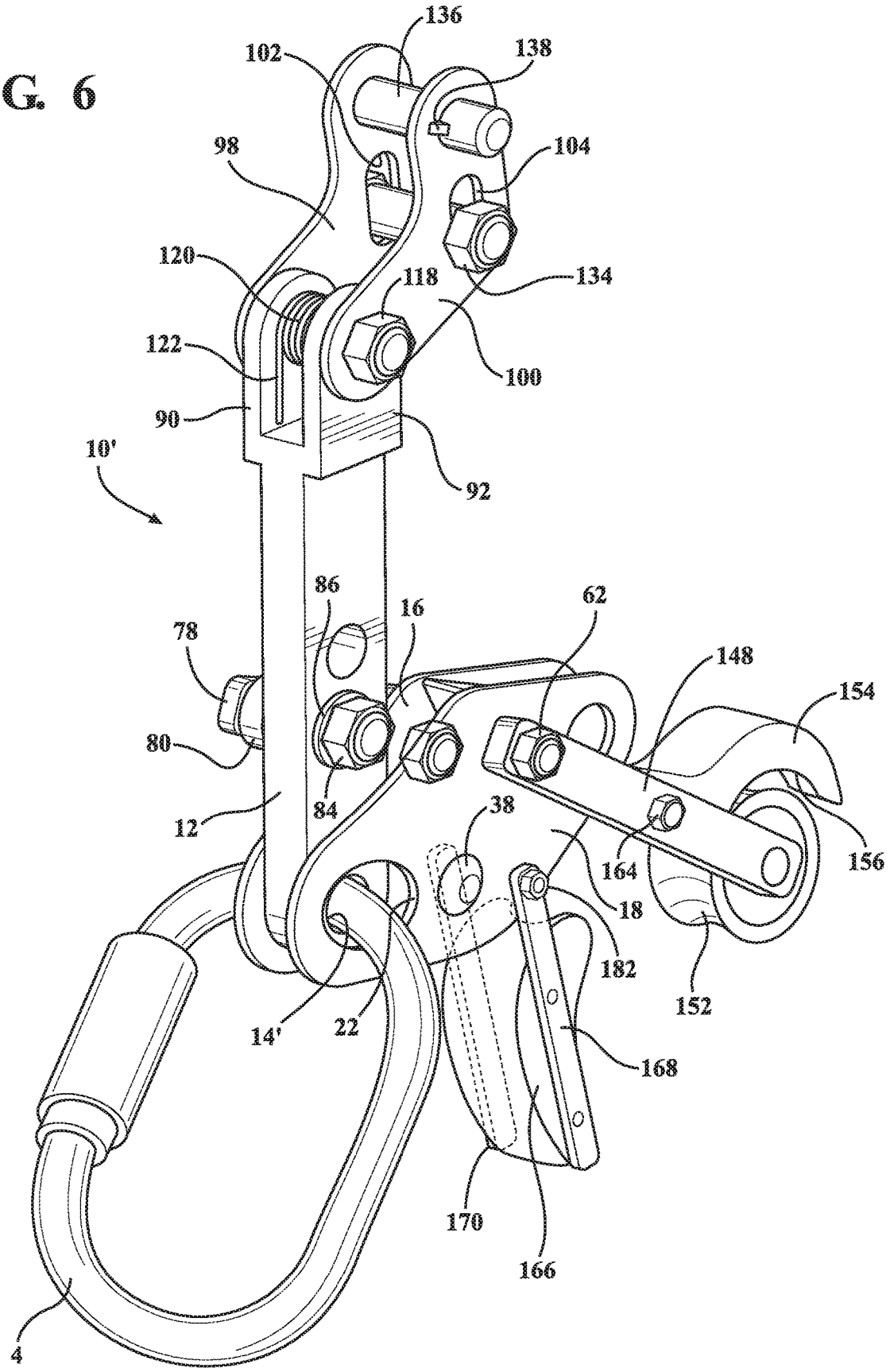
FIG. 6 is a perspective view of a further embodiment of the climbing assist mechanism similar to FIG. 1 and depicting a redesigned clutch subassembly according to the present invention.
Figure 7:
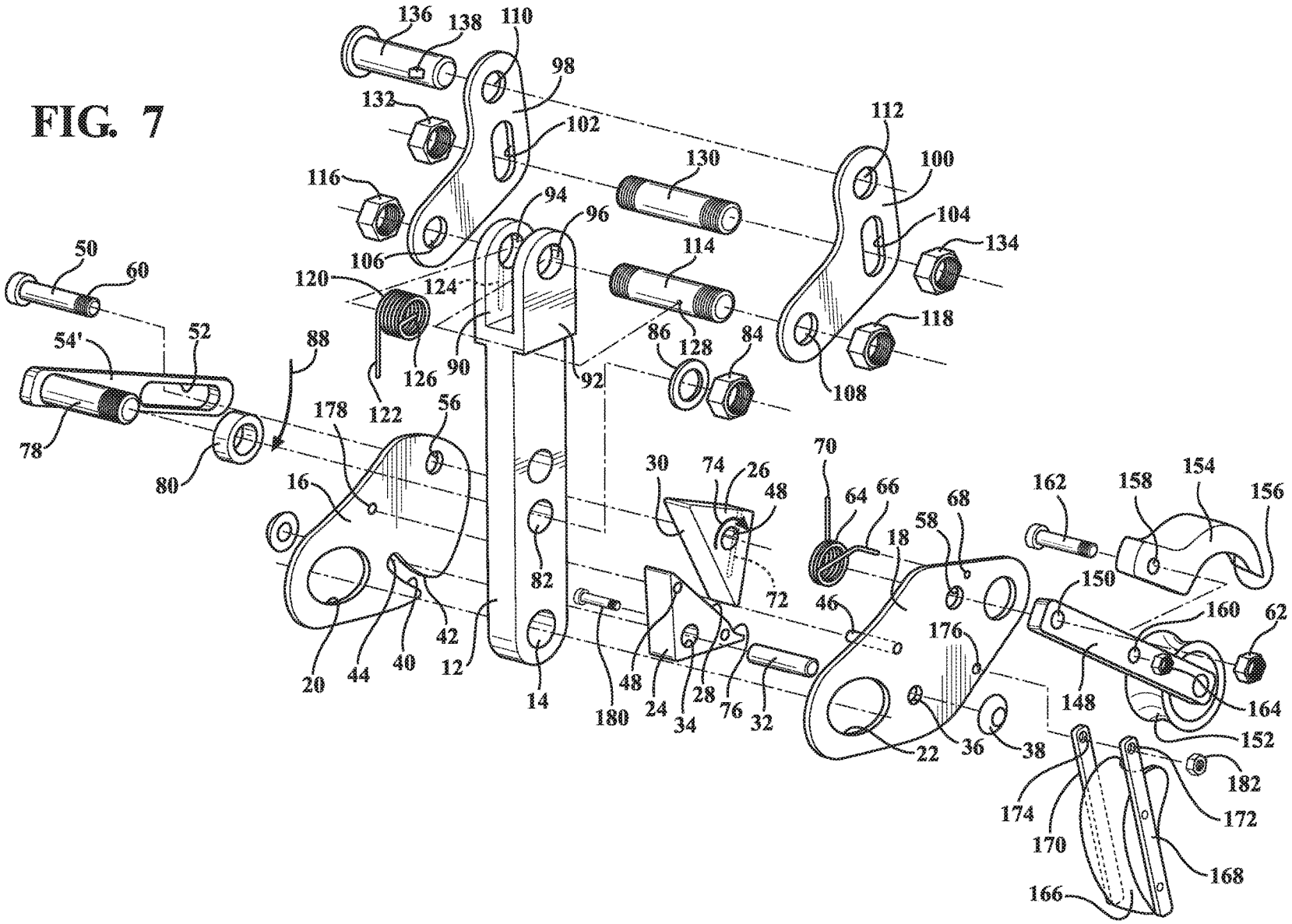
FIG. 7 is an exploded view of the climbing assist mechanism according to the embodiment of FIG. 6.

Referring initially to FIG. 6, illustrated is a perspective view of a further embodiment of the climbing assist mechanism similar to FIG. 1 and, along with the exploded view of FIG. 7, additionally depicts the redesigned aspects of the alternate clutch of the climbing assist mechanism. The lever component 54 of the first variant is redesigned/reduced in length at 54' as best shown in FIG. 7 and terminates just past the interior slot 52 (for receiving mounting bolt 50) and so as to remove the end most gripping portion 55.

The redesigned clutch subassembly includes a separate elongated member 148 having a proximal end aperture 150 which aligns with aperture 58 in the side plate 18 and is anchored directly to the plate via nut 62, this so that the associated mounting bolt 50 extends through an end-most location of the interior slot 52 configured in the lever component 54' and anchors the elongated member 148 fixedly to the side plate 18.

A roller element 152 is supported at a remote end of the elongated member 148. A first arcuate member 154 includes a recessed underside profile 156 and defines a generally hook shape. A base of the arcuate member 156 includes an aperture 158 (FIG. 7) which, upon aligning with an intermediate aperture 160 configured in the elongated member 148, receives a further bolt 162 and interiorly threaded nut 164 for pivotally securing to the elongated member in a manner such that the underside recessed profile 156 is arrayed opposing the roller element 152.

A second bean-shaped component 166 is provided and includes a pair of side extending supports 168/170, the supports in turn having end apertures 172/174 which align with apertures 176/178 (again FIG. 7) defined in the side plates 16/18 so that the support 168/170 are arranged against exterior faces of the side plates and so that the bean shaped component 166 is arranged in a pivotally opposing arrangement relative to the elongated member 148 and roller 152 so that the rope 2 translates there between.

A further bolt 180 (again FIG. 7) is provided and extends through the aligning pairs of apertures 172/174 and 176/178 and is engaged by an end nut 182. In this manner, the bean shaped component 166 is separately pivotally mounted to the plate and, in combination with the first arcuate member 154, can be compressed in a clam-shell manner to compress the rope 2 between the bean-shaped component 166 and the roller 152 (see as further shown in FIG. 10) in order to provide a variable friction and controlled descent, and such as resulting from any downward directed pivoting of the climber attached carabiner relative to the elongated tether linkage and overlapping lower side plates of the device.

Figure 8:
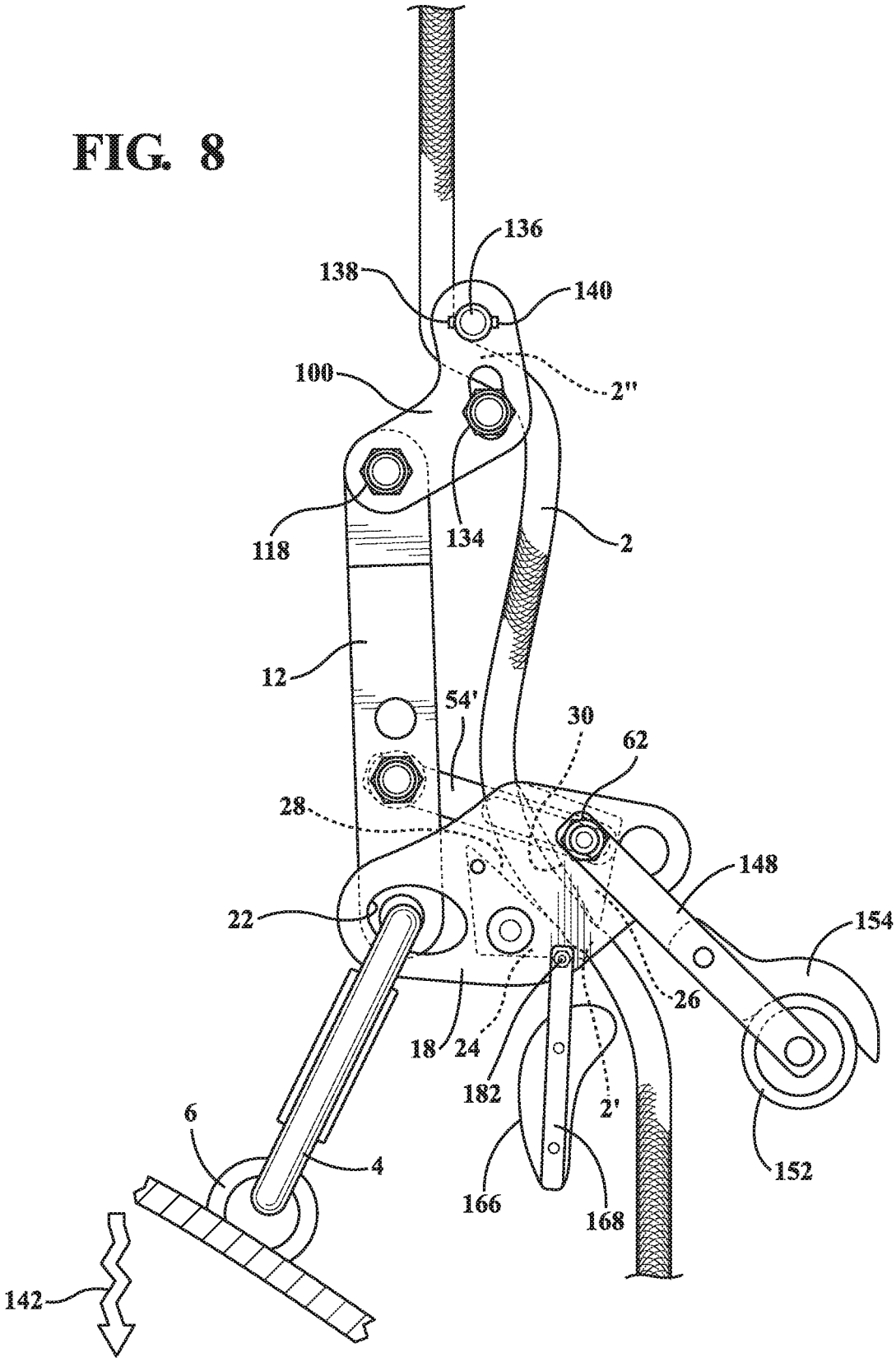
FIG. 8 is an operational depiction of the mechanism of FIG. 6 in use with the rope and depicting the clutch subassembly engaging the rope in response to any of a free fall or fall arrest condition.

FIG. 8 is an operational depiction of the mechanism of FIG. 6 (similar to that shown in FIG. 3) in use with the rope and depicting the redesigned clutch subassembly engaging the rope in response to any of a free fall or fall arrest condition in a hands-free configuration (relative to the rope) and by which the triangular shaped clutch members 24 and 26 pivot in response to the clockwise exerted bias 74 of the first torsional spring 64, again resulting in the opposing hypotenuse surfaces 28/30 gripping the rope 2 at the first location 2' to prevent further translation of the rope until the associated lever 54' is re-engaged downwardly to re-establish controlled descent. The rope is concurrently gripped at the second upper location 2" between the shaft 130 and the upper bolt key/pin 136, again via the counterclockwise bias exerted by the second torsional spring 120 on the upper "L" plates 98/100.

Figure 9:
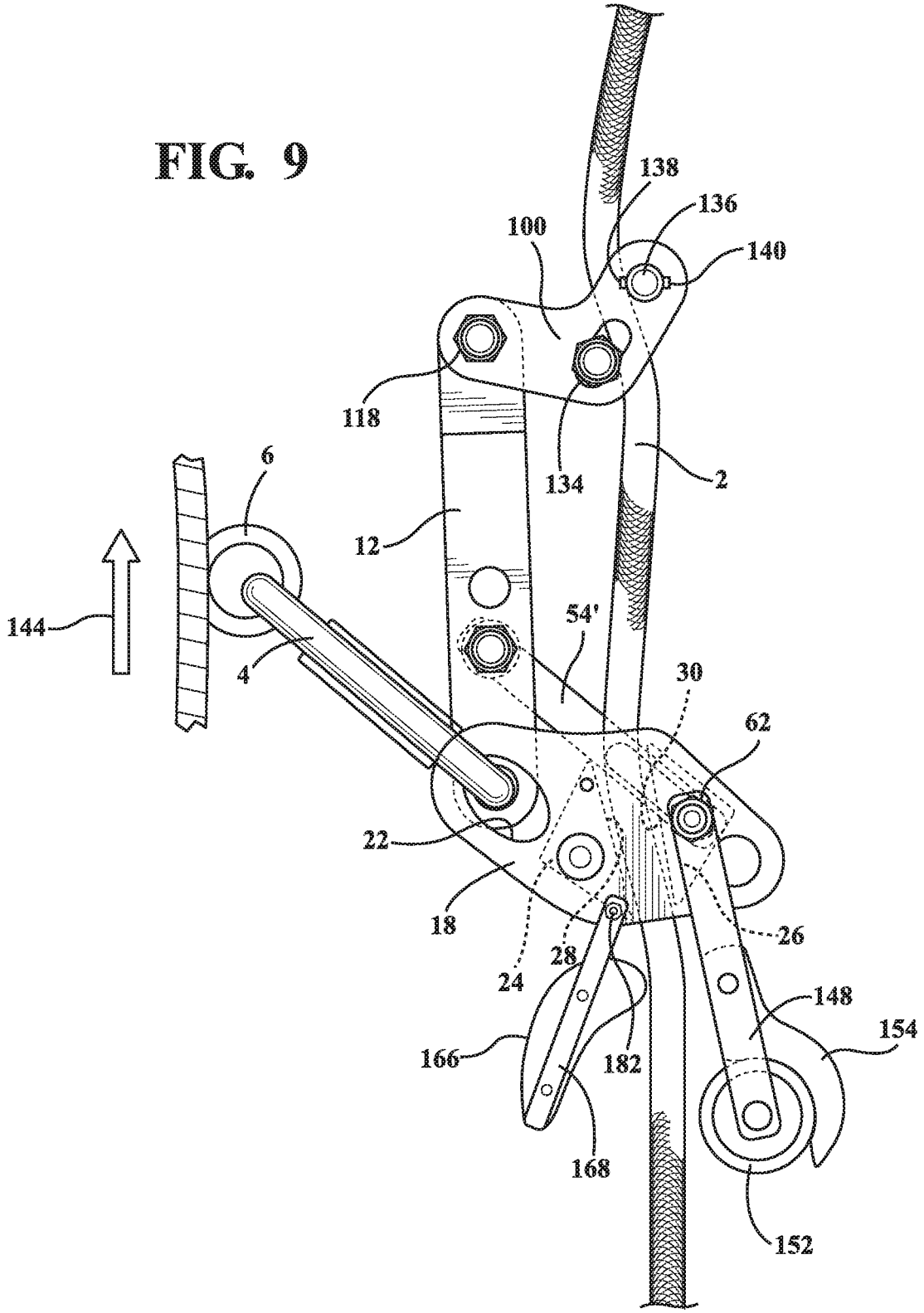
FIG. 9 is a view similar to FIG. 8 depicting the mechanism in a controlled ascent (also termed progress captures) configuration in relation to the rope translating downwardly therethrough.

FIG. 9 is a view similar to FIG. 8 (generally replicating that shown in FIG. 4 of the original variant) and depicting the mechanism in a controlled ascent (also termed progress captures) configuration in relation to the rope translating downwardly therethrough. The controlled ascent (also progress capture) configuration (see again directional arrow 144) in relation to the rope 2 translating downwardly therethrough. Similar to the first variant of FIG. 4, and in this position, the triangular clutch members 24/26 both pivot in a generally clockwise direction relative to that shown in FIG. 8, and by which the rope 2 is generally permitted to slide downwardly through the pinch points established at each of the upper "L" plates 98/100 (see clockwise rotation of plates 98/100 from position of FIG. 8 concurrent with seating of the mounting shaft 130 toward the bottom of the elongated apertures 102/104), as well as at the lower side plates 16/18 and enclosed clutch members 24/26.

Figure 10:
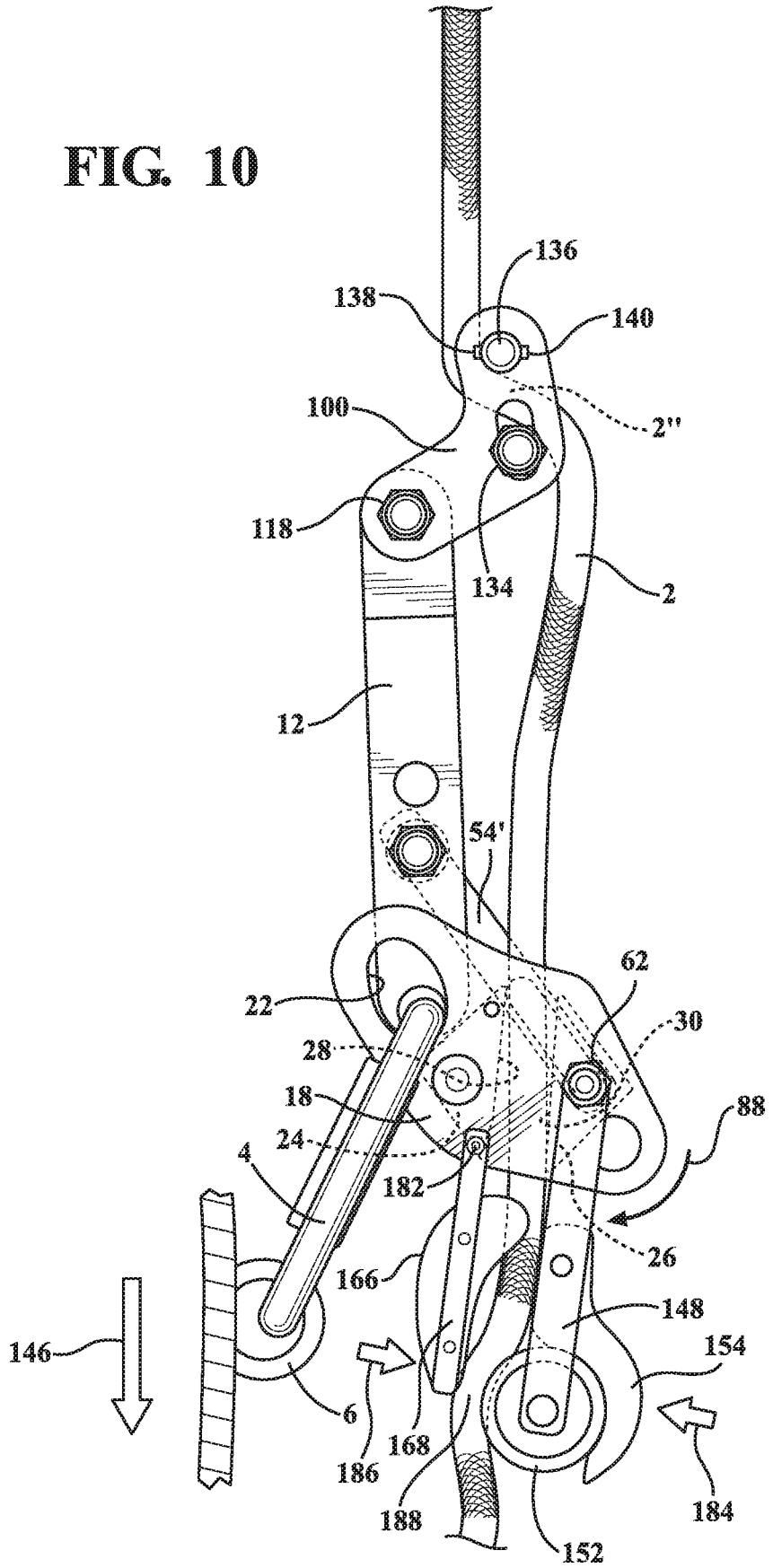
FIG. 10 is a further illustration of the redesigned mechanism of FIG. 6 with elongated roller supporting member, first arcuate gripping member and second bean-shaped gripping component capable of being compressed to pinch the extending rope location between the roller and the bean-shaped gripping component in a controlled descent (again also termed variable friction) configuration resulting from downward directed pivoting of the climber attached carabiner relative to the elongated tether linkage and overlapping lower side plates of the device.

Finally, FIG. 10 is a further illustration of the redesigned mechanism of FIG. 6 (compare to FIG. 5 in the first embodiment) in a controlled descent (again also termed variable friction) configuration resulting from downward directed pivoting of the climber attached carabiner relative to the elongated tether linkage and overlapping lower side plates of the device. According to this view, the mechanism is shown in a controlled descent (variable friction) configuration (see downward directional arrow 146) resulting from downward directed pivoting of the climber attached carabiner 4 relative to the elongated tether linkage 12 and overlapping lower side plates 16/18 of the device. In this manner, the clutch members 24/26 are further clockwise pivoted (again via downward pivoting of the lever 54) to allow for sliding of the rope therethrough and in combination with the upper "L" plates reverse (ccw) pivoting to provide a nominal degree of engagement at the upper pinch point 2".

The redesigned lever 54' further operates as a fulcrum, upon compressing the pivotally attached arcuate member 154 against the elongated member 158 (in the direction of arrow 184) to adjust an amount of mechanical advantage applied to the pinching cam of the device in order to achieve the desired variable friction for establishing controlled descent. Concurrently, the bean shaped component 166 also gripped by the user and displaced inwardly along direction 186 in order to further pinch the rope at a further location 188 in order to provide the desired variable friction for controlling user descent.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The invention claimed is:

1. A clutch assembly for a climbing rope, comprising:

a tether component pivotally supporting a pair of plates arranged on opposite sides of said tether component, said plates in turn supporting therebetween a pair of pivotal clutch members defining a first pinch point of the rope;

a carabiner pivotally attachable to said tether component through an aligning support aperture in said plates; and a lever pivotally attached to said tether component and slidably attached to said plates and which permits at least one of sliding displacement or pivoting of said plates relative to said tether component to establish each of a sliding configuration of the rope relative to said clutch members during either of a normal ascent or normal descent condition, as well as a locked configuration of said clutch members against the rope to establish a free-fall preventing condition.

2. The invention of claim 1, said clutch members each further comprising a triangular shape and exhibiting opposed hypotenuse surfaces between which translates the rope.

3. The invention of claim 2, further comprising a first torsional spring for influencing at least one of the clutch members in said locked configuration.

4. The invention of claim 3, further comprising a second pinch point of the rope established by a pair of "L" plates pivotally supported at an upper end of said tether component.

5. The invention of claim 4, further comprising a second torsional spring for pivoting said "L" plates in said locked configuration.

6. The invention of claim 5, said second pinch point further comprising a pair of spaced shafts or pins between which translates the rope.

7. The invention of claim 1, further comprising a separate elongated member anchored directly to said plates, an associated mounting bolt extending through an end-most location of an interior slot configured in said lever.

8. The invention of claim 7, further comprising a roller element supported at a remote end of said elongated member.

9. The invention of claim 8, further comprising a first arcuate member having a recessed underside profile and defining a generally hook shape, said arcuate member being pivotally securing to said elongated member in a manner such that said recessed underside profile is arrayed opposing said roller element.

10. The invention of claim 9, further comprising a second bean-shaped component pivotally opposing said elongated member and roller so that the rope translates there between and, in combination with said first arcuate member, being compressed in a clam-shell manner to compress the rope between said bean-shaped component and roller in order to provide for variable friction and controlled descent.

11. A clutch assembly for a climbing rope, comprising:

a tether component pivotally supporting a pair of plates arranged on opposite sides of said tether component, said plates in turn supporting a pair of pivotal clutch members defining a first pinch point of the rope;

a second pinch point of the rope established by a pair of "L" plates pivotally supported at an upper end of said tether component;

said clutch members each further including a triangular shape and exhibiting opposed hypotenuse surfaces between which translates the rope;

a carabiner pivotally attachable to said tether component through an aligning support aperture in said plate; and a lever pivotally attached to said tether component and slidably attached to said plate and which permits at least one of sliding displacement or pivoting of said plate relative to said tether component to establish each of a sliding configuration of the rope relative to said clutch members during either of a normal ascent or normal descent condition, as well as a locked configuration of said clutch members against the rope to establish a free-fall preventing condition.

12. The invention of claim 11, further comprising a first torsional spring for influencing at least one of the clutch members in said locked configuration.

13. The invention of claim 12, further comprising a second torsional spring for pivoting said "L" plates in said locked configuration.

14. The invention of claim 11, said second pinch point further comprising a pair of spaced shafts or pins between which translates the rope.

15. A clutch assembly for a climbing rope, comprising:

a tether component pivotally supporting a pair of plates arranged on opposite sides of said tether component, said plates in turn supporting a pair of pivotal clutch members defining a first pinch point of the rope;

a second pinch point of the rope established by a pair of "L" plates pivotally supported at an upper end of said tether component;

said clutch members each further including a triangular shape and exhibiting opposed hypotenuse surfaces between which translates the rope;

a carabiner pivotally attachable to said tether component through an aligning support aperture in said plate;

a lever pivotally attached to said tether component and slidably attached to said plate and which permits at least one of sliding displacement or pivoting of said plate relative to said tether component to establish each of a sliding configuration of the rope relative to said clutch members during either of a normal ascent or normal descent condition, as well as a locked configuration of said clutch members against the rope to establish a free-fall preventing condition;

a separate elongated member anchored directly to said plates, an associated mounting bolt extending through an end-most location of the interior slot configured in said lever;

a roller element supported at a remote end of said elongated member;

a first arcuate member having a recessed underside profile and defining a generally hook shape, said arcuate member being pivotally securing to said elongated member in a manner such that said recessed underside profile is arrayed opposing said roller element; and a second bean-shaped component pivotally opposing said elongated member and roller so that the rope translates there between and, in combination with said first arcuate member, being compressed in a clam-shell manner to compress the rope between said bean-shaped component and roller in order to provide for variable friction and controlled descent.

16. The invention of claim 15, further comprising a first torsional spring for influencing at least one of the clutch members in said locked configuration.

17. The invention of claim 16, further comprising a second torsional spring for pivoting said "L" plates in said locked configuration.

18. The invention of claim 15, said second pinch point further comprising a pair of spaced shafts or pins between which translates the rope.

19. A clutch assembly for a climbing rope, comprising:

a tether component pivotally supporting a plate, said plate in turn supporting a pair of pivotal clutch members defining a first pinch point of the rope;

said clutch members each further including a triangular shape and exhibiting opposed hypotenuse surfaces between which translates the rope;

a carabiner pivotally attachable to said tether component through an aligning support aperture in said plate; and a lever pivotally attached to said tether component and slidably attached to said plate and which permits at least one of sliding displacement or pivoting of said plate relative to said tether component to establish each of a sliding configuration of the rope relative to said clutch members during either of a normal ascent or normal descent condition, as well as a locked configuration of said clutch members against the rope to establish a free-fall preventing condition.

* * * * *